US010859210B2

(12) United States Patent
Ligonesche et al.

(10) Patent No.: US 10,859,210 B2
(45) Date of Patent: Dec. 8, 2020

(54) DEVICE FOR SUPPLYING PRESSURIZED FLUID, AND ASSEMBLY FOR STORING PRESSURIZED FLUID COMPRISING SUCH A DEVICE

(71) Applicant: L'Air Liquide, Société Anonyme pour l'Etude et l'Exploitation des Procédés Georges Claude, Paris (FR)

(72) Inventors: Renaud Ligonesche, Herblay (FR); Antoine Frenal, Ezanville (FR); Benjamin Fischer, Fresnes (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 16/787,547

(22) Filed: Feb. 11, 2020

(65) Prior Publication Data

US 2020/0256517 A1 Aug. 13, 2020

(30) Foreign Application Priority Data

Feb. 11, 2019 (FR) ..... 19 01333

(51) Int. Cl.
*F17C 13/04* (2006.01)

(52) U.S. Cl.
CPC ..... *F17C 13/04* (2013.01); *F17C 2205/0329* (2013.01); *F17C 2205/0394* (2013.01)

(58) Field of Classification Search
CPC ..... F17C 13/04; F17C 2205/0329; F17C 2205/0394; F17C 2205/0326;
(Continued)

(56) References Cited

U.S. PATENT DOCUMENTS 6,000,419 A * 12/1999 Bernhard ..... F16L 37/084 137/15.12
2008/0308181 A1 12/2008 Denis et al.
(Continued)

FOREIGN PATENT DOCUMENTS

FR 2 892 799 5/2007
FR 2 970 313 7/2012
(Continued)

OTHER PUBLICATIONS

French Search Report for corresponding FR 1901333, dated Oct. 15, 2019.
(Continued)

*Primary Examiner* — Benjamin R Shaw
(74) *Attorney, Agent, or Firm* — Elwood L. Haynes

(57) ABSTRACT

A device for supplying pressurized fluid, including a first valve accommodating an internal fluid circuit, the device including a second valve including an internal circuit, the second valve forming a separate physical entity from the first valve, the first valve and the second valve including respective coupling members that form a male/female quick-connection system for removably connecting the second valve to the first valve, the internal circuits including a set of valves configured to allow or prevent the flow of the fluid towards an outlet of the device when the second valve is coupled to the first valve via the quick-connection system.

12 Claims, 6 Drawing Sheets

(58) Field of Classification Search
CPC ..... F17C 2250/0478; F16K 37/0033; F16K 31/00; F16K 35/14; F16K 35/022
USPC ..... 222/300
See application file for complete search history.

(56) References Cited

U.S. PATENT DOCUMENTS

| | | | | |
|---|---|---|---|---|
| 2018/0024575 | A1* | 1/2018 | De Potter | F16K 37/005 137/98 |
| 2018/0038552 | A1* | 2/2018 | Frenal | F17C 7/00 |
| 2018/0045373 | A1* | 2/2018 | Frenal | F17C 13/04 |
| 2018/0087717 | A1* | 3/2018 | Fischer | F17C 1/00 |
| 2019/0219227 | A1* | 7/2019 | Frenal | F17C 13/04 |
| 2019/0242528 | A1* | 8/2019 | Frenal | F17C 13/04 |
| 2019/0293239 | A1* | 9/2019 | Frenal | F17C 13/04 |
| 2019/0368661 | A1* | 12/2019 | Paoli | F17C 13/04 |

FOREIGN PATENT DOCUMENTS

| | | |
|---|---|---|
| FR | 2 991 750 | 12/2013 |
| FR | 3 033 388 | 9/2016 |
| FR | 3 054 290 | 1/2018 |
| FR | 3 054 291 | 1/2018 |
| FR | 3 056 278 | 3/2018 |

OTHER PUBLICATIONS

French Search Report for related FR 1901331, dated Oct. 15, 2019.

* cited by examiner

[Fig.1]
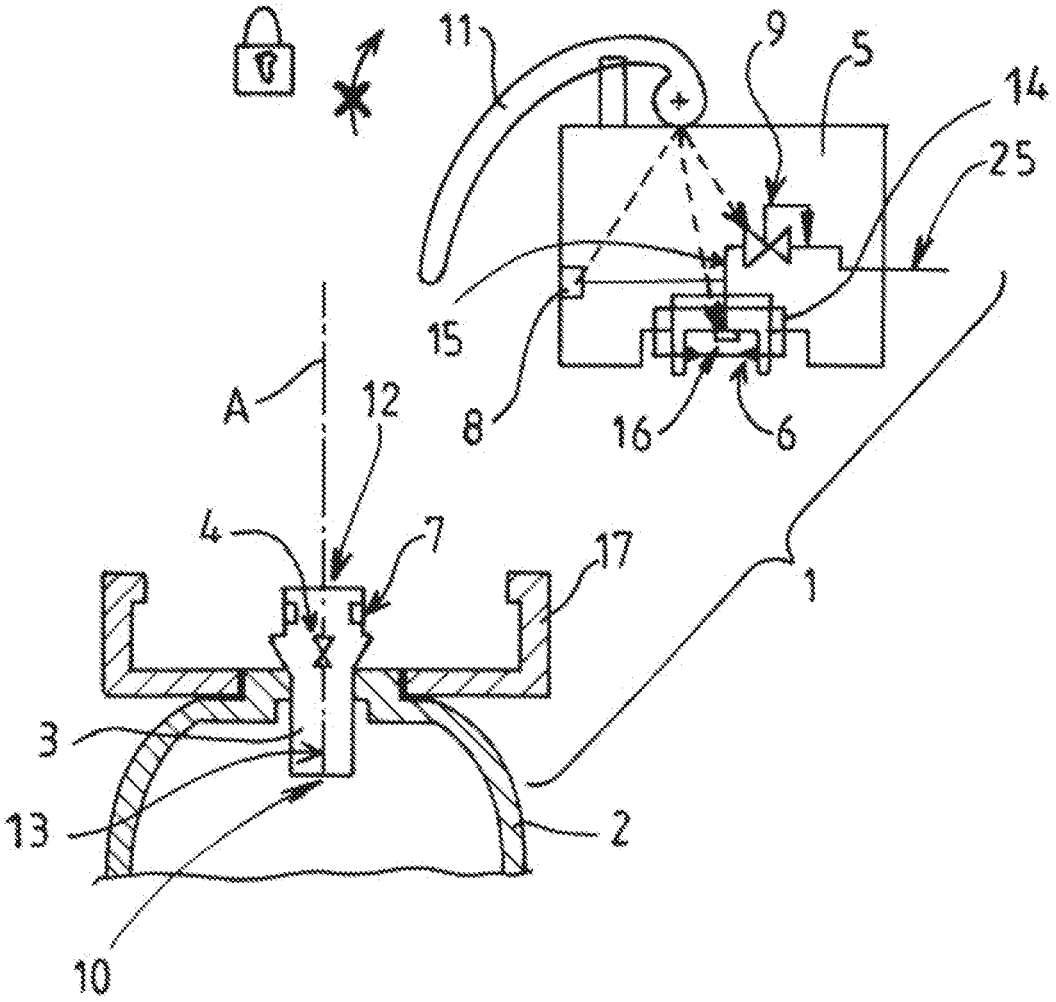

[Fig.2]
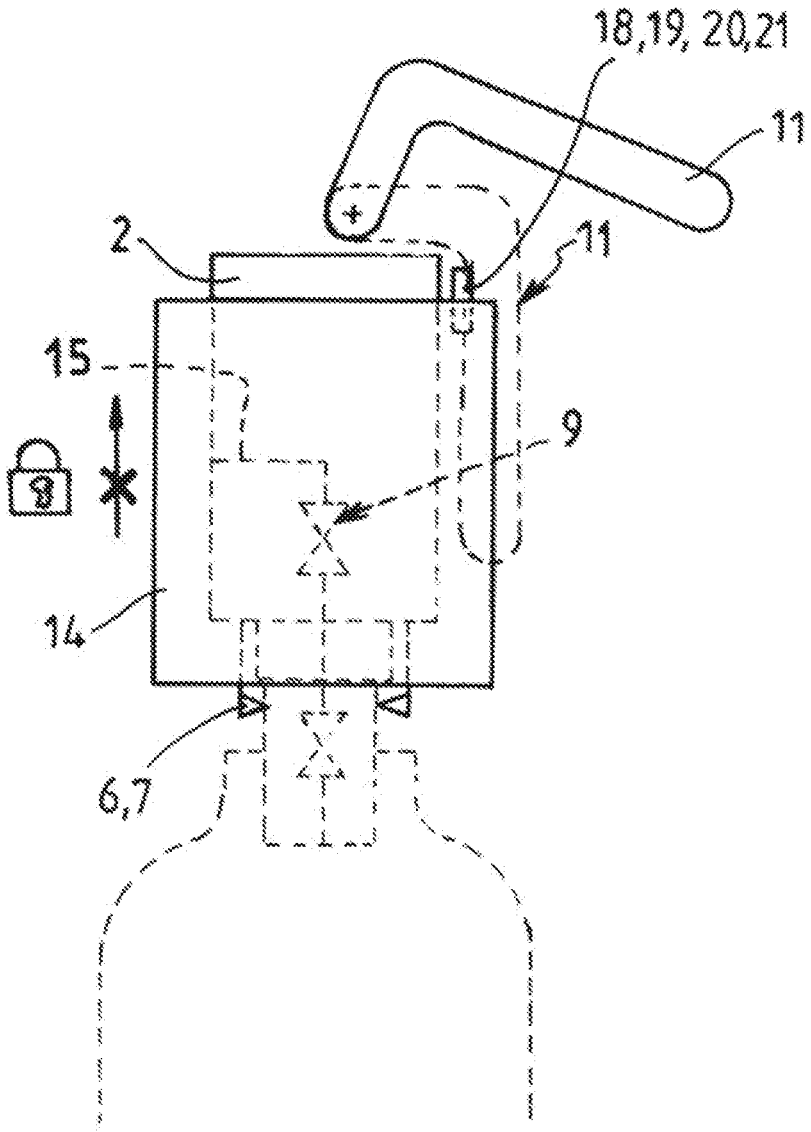

[Fig.3]
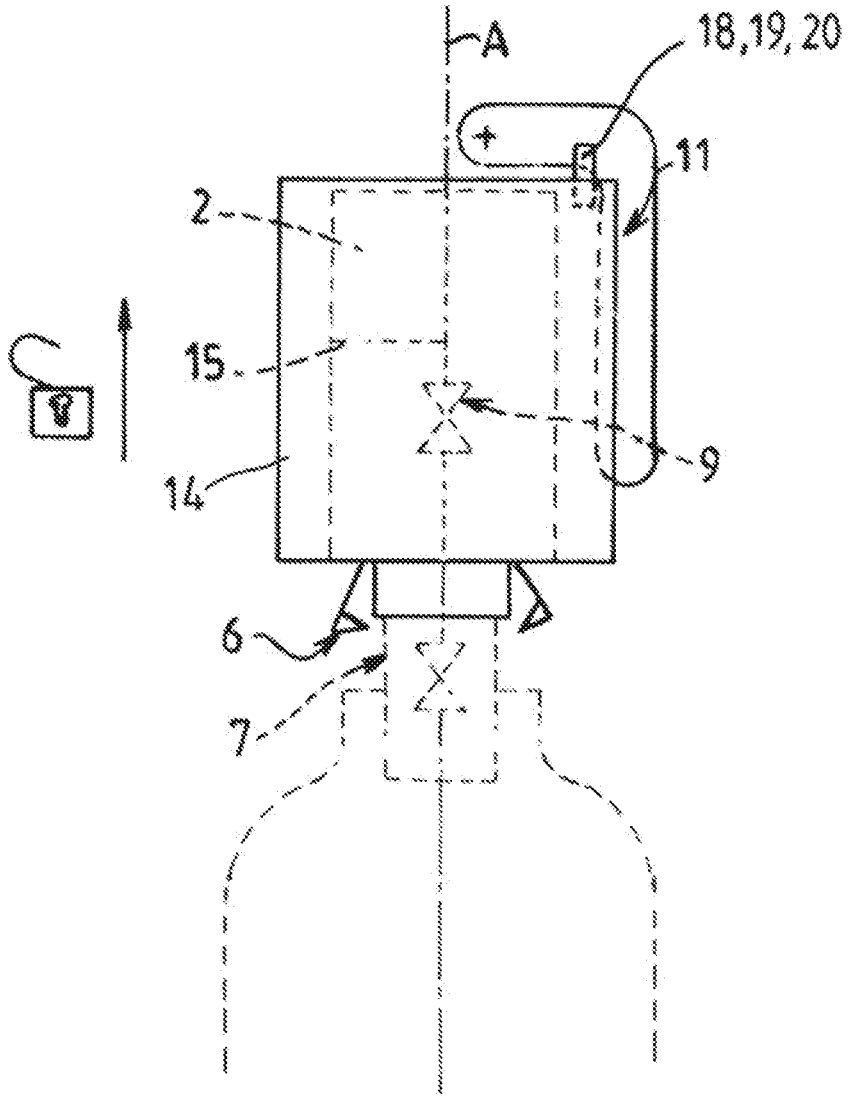

[Fig.4]
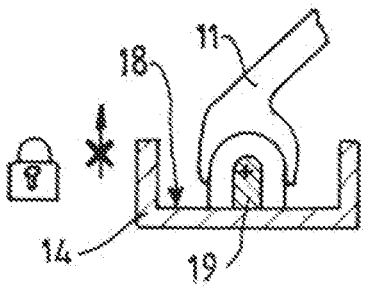
[Fig.5]
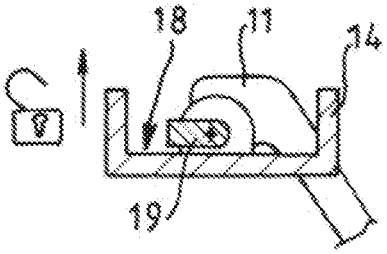
[Fig.6]
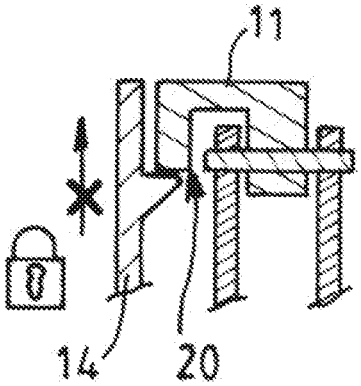

[Fig.7]
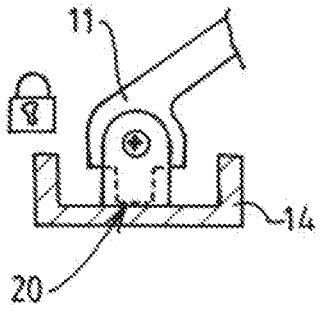
[Fig.8]
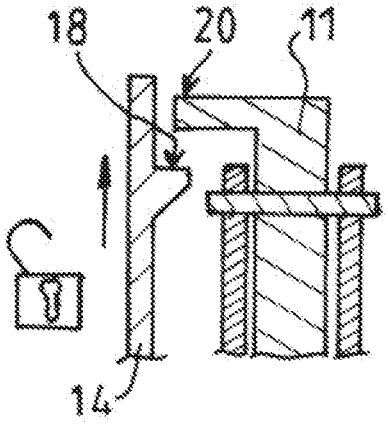

[Fig.9]
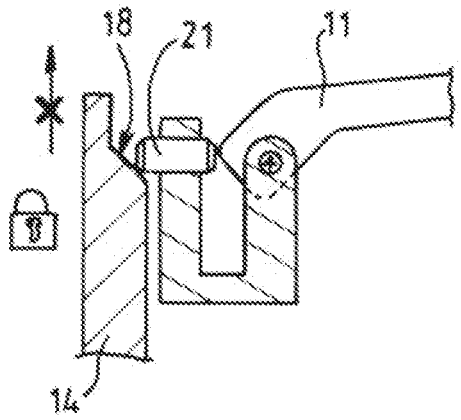
[Fig.10]
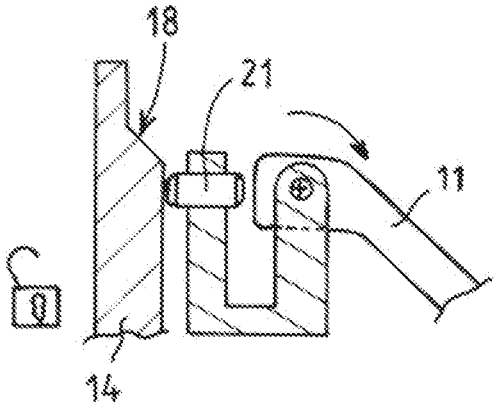

DEVICE FOR SUPPLYING PRESSURIZED FLUID, AND ASSEMBLY FOR STORING PRESSURIZED FLUID COMPRISING SUCH A DEVICE

CROSS REFERENCE TO RELATED APPLICATIONS

This application claims the benefit of priority under 35 U.S.C. § 119 (a) and (b) to French Patent Application No. 1901333, filed Feb. 11, 2019, the entire contents of which are incorporated herein by reference.

BACKGROUND

The invention relates to a device for supplying pressurized fluid and to an assembly for storing pressurized fluid comprising such a device.

The invention relates more particularly to a device for supplying pressurized fluid, in particular pressurized gas, comprising a first valve accommodating an internal fluid circuit, the device having a second valve comprising an internal circuit, the second valve forming a separate physical entity from the first valve, the first valve and the second valve comprising respective coupling members that form a male/female quick-connection system for removably connecting the second valve to the first valve, the internal circuits comprising a set of valves for allowing or preventing the flow of the fluid towards an outlet of the device when the second valve is coupled to the first valve via the quick-connection system, the device comprising at least one manually actuable movable control member for controlling the set of control valves, the control member being movable between a first, rest position, in which the flow of fluid towards the outlet is prevented, and a second, active position, in which the flow of fluid towards the outlet is allowed, the quick-connection system comprising a member for locking/unlocking the second valve on/from the first valve, the locking/unlocking member being movable between a first, unlocking position, when the quick connection between the second valve and the first valve has not been established, or allowing separation of the second valve and the first valve when the quick connection has been established between the second valve and the first valve, and a second, locking position preventing separation of the second valve and the first valve when the quick connection has been established between these latter.

The invention relates in particular to a modular device for supplying pressurized gas, comprising a fluid regulating member such as an exchangeable valve, which is connected removably to a base such as a first valve secured to a pressurized gas cylinder.

The invention may relate in particular to an architecture as described for example in the document FR3054290A1 or FR3054291A1.

In known devices, it may in certain situations be possible to attempt to separate the two coupled elements (typically, the two valves) when the gas circuit is open.

In such a situation, if the assembly is under high pressure this may damage the device and give rise to leaks and possible ejection of the second valve. If the assembly is under relatively low pressure, this may give rise to gas leaks during disconnection. Solutions are known for solving this problem: cf., for example, FR2970313 A1.

These solutions are satisfactory in ergonomic terms but may generate very high stresses at the control member (lever) or allow disconnection without really guaranteeing that the circuit is closed.

SUMMARY

An object of the present invention is to palliate all or some of the above-mentioned prior-art disadvantages.

To that end, the device according to the invention, which, furthermore, complies with the generic definition given in the above preamble, is characterized essentially in that, in its second, active position, the control member blocks the locking/unlocking member in its second position, so as to prevent the second valve and the first valve from being separated, and in that, in its first, rest position, the control member does not block the locking/unlocking member in its second position, so as to allow it to move towards its first position and thus to allow the second valve and the first valve to be separated.

Furthermore, embodiments of the invention may comprise one or more of the following features:

- the internal circuit of the first valve extends between a first, upstream end intended to be in communication with a source of pressurized fluid and a downstream end, the internal circuit of the first valve comprising an isolation valve for opening or closing the internal circuit, the internal circuit of the second valve comprising an upstream end intended to be in communication with the downstream end of the internal circuit of the first valve when the second valve is coupled to the first valve and a downstream end forming the outlet that is intended to be connected to an apparatus that uses the fluid, the second valve comprising a movable member for actuating the isolation valve of the first valve in order to open or close the latter, the movement of said movable actuating member being controlled by the control member,
- the first valve comprises a cylindrical end extending along a longitudinal axis, the quick-connection system comprising at least one groove or rib formed on the cylindrical end of the first valve and a system of coupling balls or claws that is secured to the second valve (5) and cooperates with the at least one groove or rib formed on the cylindrical end of the first valve,
- in its first position, the locking/unlocking member allows a relative offset of the coupling members forming the quick connection system and, in its second position, the locking/unlocking member reduces or does not allow the relative offset of the coupling members forming the quick connection system,
- the locking/unlocking member is mounted on the second valve so as to be movable in translation and/or rotation,
- the control member comprises a pivotable lever and/or a button that is movable in translation and/or a rotary handwheel,
- \the blocking of the locking/unlocking member by the control member is mechanical and/or magnetic and/or pneumatic blocking that is direct or via an intermediate piece such as a retractable end stop,
- the blocking of the locking/unlocking member by the control member is mechanical blocking brought about by an intermediate piece of the device that cooperates on one side with a portion of the control member and on the other side with the locking/unlocking member so as to form or not to form a mechanical end stop for the locking/unlocking member, depending on the position of the control member, the intermediate piece comprises a movable pin that is acted on by a return member, the intermediate piece comprises a stem that is secured to the control member and cooperates or does not cooperate by abutment with the locking/unlocking member, depending on the position of the control member, the blocking or otherwise of the locking/unlocking member by the control member is direct mechanical blocking between one end of the control member and a portion of the locking/unlocking member so as to form or not to form a mechanical end stop for the locking/unlocking member, depending on the position of the control member, the quick-connection system mechanically blocks the second valve on the first valve at least along a longitudinal axis, the internal circuit of the second valve comprises a downstream end provided with an outlet coupling that opens onto the peripheral surface of the second valve.

the device comprises a pressurized fluid cylinder to which the first valve is connected, the device also comprising a protective cap for the first valve that is fastened rigidly to the cylinder, in the connected position of the second valve on the first valve (quick connection established), the quick-connection system allows the second valve to rotate on the first valve about the longitudinal axis and with respect to the cap, the locking/unlocking member forms an exterior casing or ring attached to at least a part of the outer surface of the second valve, the locking/unlocking member comprises a tubular sleeve disposed around at least a part of the body of the second valve, the movable coupling members comprise balls or claws and, in its second position, the locking/unlocking member does not block the movement of the movable coupling members, and in its first position, the locking/unlocking member blocks the movement of said movable coupling members.

The invention also relates to an assembly for storing pressurized fluid, comprising a device according to any one of the features above or below.

The invention may also relate to any alternative device or method comprising any combination of the features above or below within the scope of the claims.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein:

FIG. 1 shows a schematic and partial view in cross section, illustrating an exemplary embodiment of a device for supplying fluid in a disconnected or separated configuration, FIG. 2 shows a schematic and partial view in cross section, illustrating a use configuration of a device for supplying fluid in a coupled/connected (locked) configuration, FIG. 3 shows a view similar to that of FIG. 2 in a partially coupled/connected (unlocked) configuration, FIG. 4 shows a schematic, partial view in cross section of a detail of the device, illustrating a first exemplary embodiment of a disengageable blocking system of the locking/unlocking member in a first (blocked) state, FIG. 5 shows a view similar to that of FIG. 4 in a second (unblocked) state, FIG. 6 shows a schematic, partial view in cross section of a detail of the device, illustrating a second exemplary embodiment of a disengageable blocking system of the locking/unlocking member (14) in a first (blocked) state, FIG. 7 shows a view similar to that of FIG. 6 in another direction, FIG. 8 shows a view similar to that of FIG. 6 in a second (unblocked) state, FIG. 9 shows a schematic, partial view in cross section of a detail of the device, illustrating a third exemplary embodiment of a disengageable blocking system of the locking/unlocking member in a first (blocked) state, FIG. 10 shows a view similar to that of FIG. 9 in a second (unblocked) state.

DETAILED DESCRIPTION OF PREFERRED EMBODIMENTS

FIG. 1 shows a device 1 for supplying pressurized fluid, in particular pressurized gas, comprising a first valve 3 mounted in the orifice of a tank 2 and surrounded by a protective cap 17. Naturally, this first valve 3 could be connected to an array of cylinders (cylinder bundle, for example).

The first valve 3 accommodates an internal fluid circuit 13 provided with at least one isolation member 4 for opening or closing the internal circuit 13. The isolation member 4 is an isolation valve, for example.

The device 1 comprises a second valve 5 forming a distinct (separable) physical entity from the first valve 3 (in a disconnected position in FIG. 1, in a partially connected/coupled position in FIG. 3 and in a correctly connected/coupled position in FIG. 2).

The second valve 5 is provided with an internal fluid circuit 15 comprising a first, upstream end intended to be fluidically connected to a downstream end 12 of the internal circuit 13 of the first valve 3. The two valves 3, 5 are configured to put their internal circuits 13, 15 into communication when the second valve 5 has been correctly coupled to the first valve 3 via the quick-connection system.

The internal circuit 13 of the second valve 5 may comprise, for example, at least one member 9 for controlling the fluid flow (for example a control valve and/or a fixed or variable pressure reducer and/or a flow rate regulator). The second valve 5 preferably also comprises a movable member 16 for actuating the isolation member 4 of the first valve 3 in order to open or close the latter. For example, the movable actuating member 16 comprises a movable valve driver, the movement (for example, the translational movement) of which is controlled by a manual control member 11 carried by the second valve 5. The control member 11 comprises a lever 11 in this example, but could comprise a push-button, a handwheel or any other appropriate member. The lever 11 can, if necessary, control the member 9 for controlling the flow of fluid.

The first valve 3 and the second valve 5 comprise respective coupling members 6, 7 that form a male/female quick-connection/coupling system for removably connecting/coupling the second valve 5 to the first valve 3.

For example, the first valve 3 comprises a cylindrical terminal end extending along a central longitudinal axis A, to which the second valve 5 is connected. The quick-connection system may comprise at least one groove 7 or rib formed on the cylindrical end of the first valve 3 and a system of claws 6 or balls (or any appropriate equivalent coupling element) secured to the second valve 5.

The coupling element(s) 6 of the second valve 5 are preferably movable and can be locked/unlocked by, for example, a movable locking/unlocking member 14 on the second valve 5 (cf. FIG. 2 and FIG. 3). The coupling element(s) 6 of the second valve 5 cooperate with the at least one groove or rib 7 formed on the cylindrical end of the first valve 3.

The lever 11 is movable between a first, rest position, in which the flow of fluid towards the outlet 25 is prevented (cf. for example the low position of the lever 11 in FIG. 1 or the broken-line position in FIG. 2 or FIG. 3), and a second, active position, in which the flow of fluid towards the outlet 25 is allowed (cf. the position in FIG. 3).

The locking/unlocking member 14 is movable between a first position, in which the quick connection between the second valve 5 and the first valve has not been established (cf. FIG. 1 or FIG. 3), and a second position, in which the quick connection between the second valve 5 and the first valve 3 has been established (cf. FIG. 2).

For example, this locking/unlocking member 14, depending on the position thereof, allows or does not allow the movement of the movable coupling members 6 (and thus a mechanical connection/disconnection). In particular, in its second position, the locking/unlocking member 14 does not allow the movement of the movable coupling members 6 (blocking/locking in a mechanically connected position).

This locking/unlocking member 14 is thus an indicator between a correct (for example locked) connection, for the one part, and a lack of connection or incorrect or incomplete connection (no mechanical connection or incomplete, non-locked connection), for the other part.

According to an advantageous particular feature, in the second, active position the control lever 11 blocks the locking/unlocking member 14 in the second position thereof, so as to prevent separation of the second valve 5 and the first valve 3 (cf. closed padlock and struck-through arrow in FIG. 2).

Moreover, in its first, rest position the lever 11 does not block the locking/unlocking member 14 in the second position thereof, so as to allow the movement thereof towards its first position and thus to permit the separation of the second valve 5 and the first valve 3 (cf. open padlock and arrow not struck-through in FIG. 3).

Thus, this architecture prevents disconnection of the second valve 5 from the first valve 3 if the lever 11 is in its position that commands the opening of the one or more internal circuits. This blocking is preferably achieved via the locking/unlocking member 14.

This blocking of the locking/unlocking member 14 by the control level 11 may be direct or indirect and preferably mechanical, but could be magnetic and/or pneumatic or otherwise.

In the example of FIG. 4 and FIG. 5, the locking/unlocking member 14 may have a shape 18 or protuberance (an end stop, for example). At least one end of the rotation shaft of the lever 11 may be provided likewise with a combined shape or protuberance 19 (for example, of blade, boss, square, flat, etc. form).

In the coupled and locked position (locking/unlocking member 14 in the low position, for example), if the lever 11 is in its second, active position (for example, raised) a portion 18 of the locking/unlocking member 14 abuts against the protuberance 19 of the shaft of the lever 11 (cf. FIG. 6). This prevents the movement of the locking/unlocking member 14 (for example, upwards) and thus prevents the separation of the two modules 3, 5.

If the lever 11 is in its first, rest position (for example, lowered), the protuberance 19 of the rotation shaft of the lever 11 is offset by rotation, for example, upwards, and releases the locking/unlocking member 14. This allows the movement of the locking/unlocking member 14 towards its first position (for example, upwards) and thus allows the separation of the two modules 3, 5.

In the example in FIG. 6, FIG. 7 and FIG. 8, the locking/unlocking member 14 is provided with a shape 18 or protuberance (an end stop, such as a ridge). A zone of the lever 11 is provided likewise with a shape or protuberance 20 (blade and/or boss and/or square and/or flat, etc.).

In the coupled and locked position (locking/unlocking member 14 in the low position, for example), if the lever 11 is in its second, active position (for example, raised) the locking/unlocking member 14 abuts against the protuberance 20 of the shaft of the lever 11 (cf. FIG. 6 or FIG. 7). This prevents the movement of the locking/unlocking member 14 (for example, upwards) and thus prevents the separation of the two modules 3, 5.

If the lever 11 is moved into its first, rest position (for example, lowered), the protuberance 20 of the lever 11 is offset by rotation and releases the locking/unlocking member 14. This allows the movement of the locking/unlocking member 14 towards its first position (for example, upwards) and thus allows the separation of the two modules 3, 5.

In the example of FIG. 9 and FIG. 10, the locking/unlocking member 14 is provided with a zone 18 or active portion, for example, a sloping profile (of the cam type, in particular).

In the coupled and locked position (locking/unlocking member 14 in the low position, for example), if the lever 11 is in it second, active position (for example, high, raised position) a face of the lever 11 (a face of a cam of the lever 11, for example) pushes a pin 21 that may be free in terms of translation in its support.

This pin 21 is positioned, for example, on a bottom part of the active zone 18 of the locking/unlocking member 14 (cf. FIG. 9). This configuration forms an end stop that prevents the movement of the locking/unlocking member 14 (for example, upwards) and thus prevents the separation of the two modules 3, 5.

If the lever 11 is moved into its first, rest position (for example, lowered), the cam of the lever 11 no longer pushes the pin 21 that is free in terms of translation in its housing. In the event of translational movement of the locking/unlocking member 14 towards its first, unlocking position, the active zone 18 is able to push the pin 21 (opposite direction) without constraint. The locking/unlocking member 14 is thus able to move so as to allow the separation of the two modules 3, 5. In an alternative, the pin 21 (or stud) may be constrained by a return member, such as a spring, towards a retracted position, thereby releasing the locking/unlocking member 14.

In the above examples, the retractable blocking mechanism acts on the locking/unlocking member 14. Naturally, in a variant or in combination, it could act on one of the coupling members 6, 7 of the quick connection.

Furthermore, the same principle and all or some of the above examples may be used in a similar fashion to prevent the connection of the second valve 5 on the first valve 3 if the lever 11 is in its second, active position. That is to say, the lever 11 blocks, in this case, the locking/unlocking member 14 and prevents it from moving into the second, locking position if the lever 11 is in the active position. The locked mechanical coupling of two valves 3, 5 is not possible whilst the lever 11 is not in the rest position.

Similarly, the device may have the following particular feature: when the locking/unlocking member 14 is in its (first) position of not locking the quick connection between the two valves (quick connection not established or not locked), this locking/unlocking member 14 (directly or indirectly) blocks the lever 11 in its first, rest position so as to prevent the movement thereof towards its second, active position of opening the circuit. Moreover, in its (second) position of locking the quick connection between the two valves (quick connection established and locked), this locking/unlocking member 14 does not in this case block the lever 11 in its first, rest position so as to allow the movement thereof towards its second, active position of opening the circuit. This affords additional security: it is impossible to open the circuits whilst the two valves are not correctly coupled mechanically.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above

What is claimed is:

1. A device for supplying pressurized fluid, comprising a first valve accommodating an internal fluid circuit, the device comprising a second valve comprising an internal circuit, the second valve forming a separate physical entity from the first valve, the first valve and the second valve comprising respective coupling members that form a male/female quick-connection system for removably connecting the second valve to the first valve, the internal circuits comprising a set of valves configured to allow or prevent the flow of the fluid towards an outlet of the device when the second valve is coupled to the first valve via the quick-connection system, the device comprising at least one manually actuable movable control member for controlling the set of control valves, the control member being movable between a first, rest position, in which the flow of fluid towards the outlet is prevented, and a second, active position, in which the flow of fluid towards the outlet is allowed, the quick-connection system comprising a member for locking/unlocking the second valve on/from the first valve, the locking/unlocking member being movable between a first, unlocking position, when the quick connection between the second valve and the first valve as not been established, or allowing separation of the second valve and the first valve when the quick connection has been established between the second valve and the first valve, and a second, locking position preventing separation of the second valve and the first valve when the quick connection has been established between these latter, wherein, in the second, active position, the control member blocks the locking/unlocking member in the second position, so as to prevent the second valve and the first valve from being separated, and in that, in the first, rest position, the control member does not block the locking/unlocking member in the second position, so as to allow movement towards the first position and thus to allow the second valve and the first valve to be separated.

2. The device according to claim 1, wherein the internal circuit of the first valve extends between a first, upstream end configured to be in communication with a source of pressurized fluid and a downstream end, the internal circuit of the first valve comprising an isolation valve for opening or closing the internal circuit, the internal circuit of the second valve comprising an upstream end configured to be in communication with the downstream end of the internal circuit of the first valve when the second valve is coupled to the first valve and a downstream end forming the outlet that is intended to be connected to an apparatus that uses the fluid, the second valve comprising a movable member for actuating the isolation valve of the first valve in order to open or close the latter, the movement of said movable actuating member being controlled by the control member.

3. The device according to claim 1, wherein the first valve comprises a cylindrical end extending along a longitudinal axis (A), the quick-connection system comprising at least one groove or rib formed on the cylindrical end of the first valve and a system of coupling balls or claws that is secured to the second valve and cooperates with the at least one groove or rib formed on the cylindrical end of the first valve.

4. The device according to claim 1, wherein, in the first position, the locking/unlocking member allows a relative offset of the coupling members forming the quick connection system and in that, in the second position, the locking/unlocking member reduces or does not allow the relative offset of the coupling members forming the quick connection system.

5. The device according to claim 1, wherein the locking/unlocking member is mounted on the second valve so as to be movable in translation and/or rotation.

6. The device according to claim 1, wherein the control member comprises a pivotable lever and/or a button that is movable in translation and/or a rotary handwheel.

7. The device according to claim 1, wherein the blocking of the locking/unlocking member by the control member is mechanical and/or magnetic and/or pneumatic blocking that is direct or via an intermediate piece such as a retractable end stop.

8. The device according to claim 7, wherein the blocking of the locking/unlocking member by the control member is mechanical blocking brought about by an intermediate piece of the device that cooperates on one side with a portion of the control member and on the other side with the locking/unlocking member so as to form or not to form a mechanical end stop for the locking/unlocking member, depending on the position of the control member.

9. The device according to claim 8, wherein the intermediate piece comprises a movable pin that is acted on by a return member.

10. The device according to claim 8, wherein the intermediate piece comprises a stem that is secured to the control member and cooperates or does not cooperate by abutment with the locking/unlocking member, depending on the position of the control member.

11. The device according to claim 8, wherein the blocking or otherwise of the locking/unlocking member by the control member is direct mechanical blocking between one end of the control member and a portion of the locking/unlocking member so as to form or not to form a mechanical end stop for the locking/unlocking member, depending on the position of the control member.

12. An assembly for storing pressurized fluid, comprising a device according to claim 1.

* * * * *